US007361227B2

(12) United States Patent
Mitchell

(10) Patent No.: US 7,361,227 B2
(45) Date of Patent: Apr. 22, 2008

(54) GAS SUPPLY SYSTEM FOR A POWDER-FLUIDIZING APPARATUS

(75) Inventor: Joseph L. Mitchell, Boyertown, PA (US)

(73) Assignee: Arkema, Inc., Philadelphia, PA (US)

( * ) Notice: Subject to any disclaimer, the term of this patent is extended or adjusted under 35 U.S.C. 154(b) by 402 days.

(21) Appl. No.: 10/652,844

(22) Filed: Aug. 29, 2003

(65) Prior Publication Data

US 2005/0048201 A1 Mar. 3, 2005

(51) Int. Cl.
*B05C 11/10* (2006.01)

(52) U.S. Cl. ..... 118/699; 118/702; 118/629; 118/64; 118/62

(58) Field of Classification Search ..... 118/627, 118/629, 64, 62, 308, 309, DIG. 5, 699, 702; 422/143

See application file for complete search history.

(56) References Cited

U.S. PATENT DOCUMENTS 3,888,423 A * 6/1975 Ganiaris ..... 239/567
3,918,401 A * 11/1975 Blakeslee ..... 118/630
4,262,039 A 4/1981 Gyarmati et al.
5,242,718 A * 9/1993 Gillette et al. ..... 427/459
5,454,256 A * 10/1995 Gimben et al. ..... 73/29.01
5,766,557 A * 6/1998 Luy et al. ..... 422/139

* cited by examiner

*Primary Examiner*—George Koch
(74) *Attorney, Agent, or Firm*—RatnerPrestia

(57) ABSTRACT

A coating apparatus includes a container and a perforated plate separating a plenum from a coating chamber. A gas supply system delivers a gas to the plenum in a sufficient amount for passage of the gas through the plate and suspension of a powder in a fluidized condition in the chamber. The gas supply system preferably includes a primary portion for continuously delivered gas and a controllable pulsing portion for supplementing the gas from the primary portion. In a first mode of operation, the gas from the pulsing portion is cycled to provide variation in the fluidized volume. In a second mode, the pulsing portion delivers relatively long pulses of gas to mix the fluidized powder.

21 Claims, 7 Drawing Sheets

GAS SUPPLY SYSTEM FOR A POWDER-FLUIDIZING APPARATUS

FIELD OF THE INVENTION

The present invention relates to apparatuses for coating articles. More particularly, the present invention relates to an apparatus for coating heated articles by immersion in a fluidized bed of powdered material.

BACKGROUND OF THE INVENTION

Prior art coating apparatuses include a box-like container and a diffuser plate dividing the container into a coating chamber and a plenum. Very fine pores perforate the diffuser plate such that a gas, typically air, is forced through the plate from the plenum to suspend a powder in the coating chamber. The powder suspended in this manner is sometimes referred to as a "fluidized bed". The upper end of the container is open to provide for immersion of a heated article in the fluidized bed. The powder melts upon contact with the heated article to form a coating.

Coating problems can result from, or be aggravated by lack of relative movement between the article being immersed and the fluidized bed of material.

It is known to include pneumatic or electric agitation devices secured to the container of prior art coating apparatuses. The agitation devices promote particle movement within a fluidized bed of material in the coating chamber. The resulting agitation, however, is uneven with the particles nearer the devices being moved to a greater extent. Agitation of particles by such mechanical means is of particularly limited benefit in those situations where the fluidized bed includes a large mass of material.

The sources for coating problems in powder coating apparatuses of the prior art was not limited to lack of motion of the part being dipped. Coating problems would also result from, or be aggravated by, particle size gradients and temperature gradients. A powdered coating material includes particles of varying diameter. The particles can become stratified in the fluidized powder over time because of gravity effects, with larger particles concentrating near the bottom of the coating chamber. The amount of heat that is required to raise the temperature of the powder by a given amount will increase as the average particle size increases. As a result, a temperature gradient develops in the fluidized bed of prior art apparatuses creating a relatively "cold" stratum near the bottom of the coating chamber.

The formation of a temperature gradient in the fluidized bed of the prior art devices results in the application of coatings of non-uniform thickness. Insufficient heat for melting the larger and cooler particles clustered near the bottom of the coating chamber results in the application of thin coatings susceptible to pinholes. The smaller and hotter particles near the upper surface of the fluidized bed sometimes results in excess powder melting and undesirable formations such as "icicles" or "angel hair".

Continuous coating lines are particularly prone to developing a temperature gradient in the fluid bed. The fluid bed in this type of coating process is typically situate in close proximity to the preheat and post fuse ovens. The resin in the top stratum of the fluid bed approaches its melt point because sufficient heat is transferred from the continuous dipping of parts and from the ovens. It is necessary to refrigerate the fluidizing air to prevent the resin from melting.

The relatively cool fluidizing gas increases in temperature as it travels upwardly through the fluidized bed, resulting in the removal of heat from the powder in a disproportionate manner, and an increase in the temperature gradient. The increased temperature gradient further increases the likelihood for coating thickness variation or other undesirable formations.

SUMMARY OF THE INVENTION

According to the present invention, there is provided an apparatus for coating an article by immersion of the article in a fluidized bed of a powdered material. The apparatus includes a container defining an interior and a plate separating the interior into a coating chamber and a plenum. The plate is perforated by a plurality of pores to provide for passage of a gas from the plenum to the coating chamber. The apparatus also includes a gas supply system connected to the plenum for delivery of a gas in a sufficient quantity for fluidized suspension of a powdered material.

The gas supply system includes a controllable source of gas to provide for intermittent delivery of gas to the plenum and a corresponding variation in the fluidized powder volume and/or agitation of the powder. The gas supply system further includes a controller for controlling the delivery of gas from the controllable source.

According to a preferred embodiment, the gas delivered by the controllable source is compressed air. The gas supply system includes a valve having opened and closed conditions. The gas supply system further includes a timer and/or a limit switch operably connected to the valve to control the delivery of compressed air.

Preferably, the gas supply system includes a blower for delivering fluidizing air to the plenum, which is supplemented by the air delivered by the controllable source. The blower is capable of operation in a substantially continuous manner. The blower and controllable source provide for first and second modes of operation. In the first mode, the controllable portion delivers pulses resulting in cyclic variation in the fluidized powder volume. In the second mode, the controllable portion delivers relatively long duration pulses with respect to the first mode pulses to promote powder mixing.

DETAILED DESCRIPTION OF THE DRAWINGS

Figure 1:
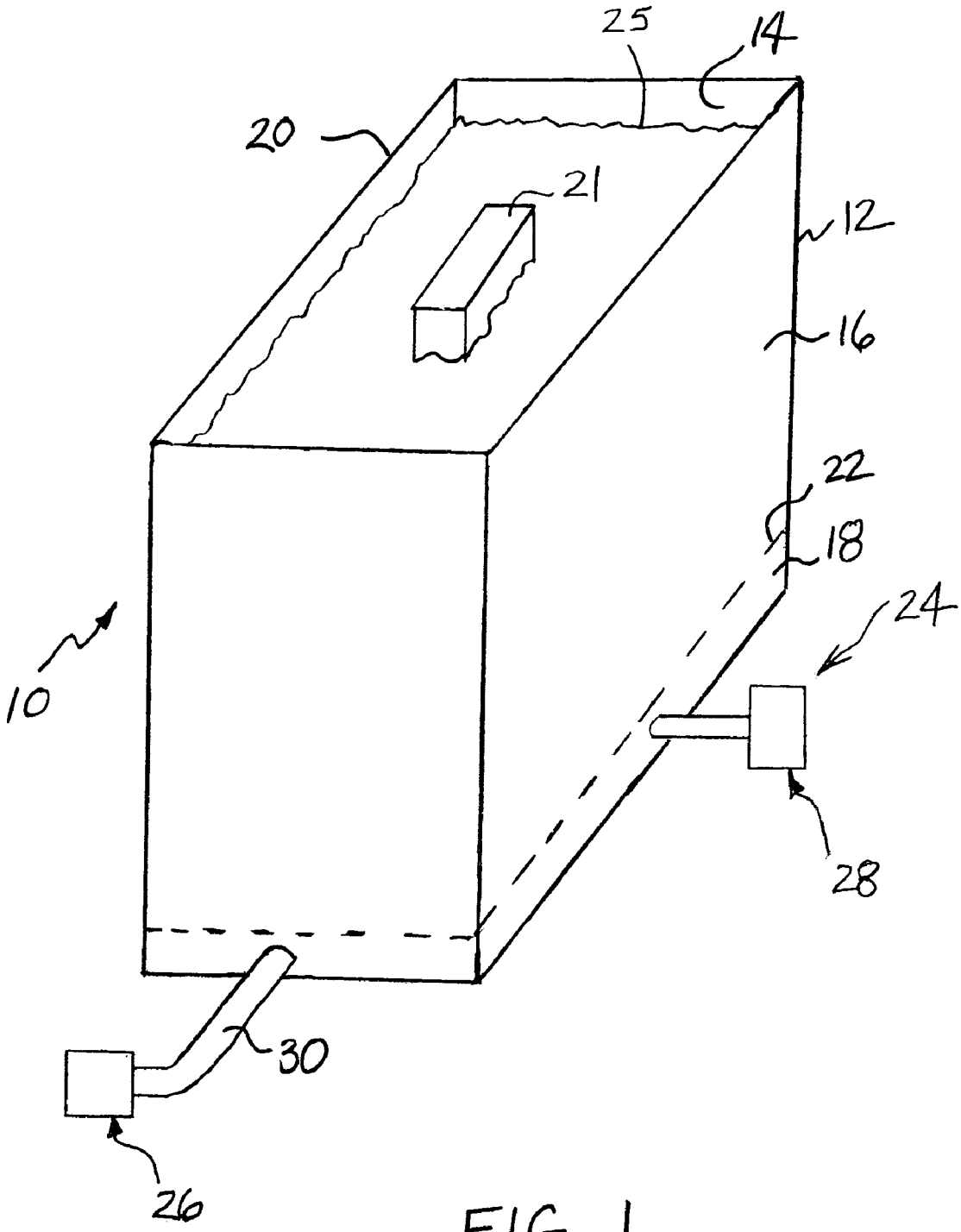
FIG. 1 is a perspective view illustrating a powder-fluidizing coating apparatus according to the present invention.

Referring to the drawings, where like numerals identify like elements, there is shown apparatuses according the present invention for coating articles by immersion in a powdered coating material suspended in a fluidized condition. As will be described in greater detail, the apparatus is adapted to provide for cycled variation of the fluidized powder volume or for mixing the fluidized powder to prevent coating problems associated with prior art devices.

Figure 2:
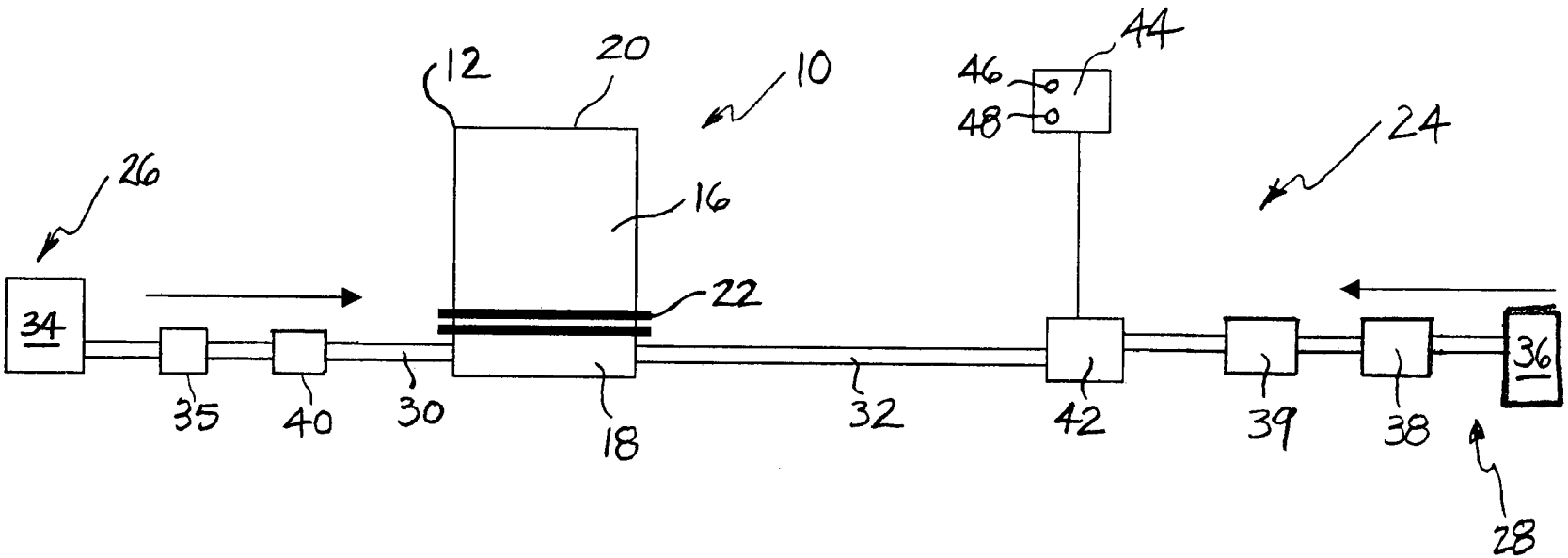
FIG. 2 is a schematic illustration of the coating apparatus of FIG. 1.

Referring to FIGS. 1 and 2, there is shown an apparatus 10 according to the present invention. The apparatus includes a container 12 that is substantially box-like. An interior 14 defined by the container 12 includes a coating chamber 16 and a plenum 18, respectively located in upper and lower portions of the container 12. An upper end 20 of the container 12 is open to provide access to the coating chamber 16 for insertion of an article 21.

The container 12 further includes a diffuser plate 22 extending across its interior 14 to separate the plenum 18 from the coating chamber 16. The diffuser plate 22 is preferably made from a plastic material such as polyester or polypropylene and is perforated by extremely fine pores. A gas supply system 24, described in greater detail below, is connected to the container 12 for delivery of a gas, most preferably air, into the plenum 18. The gas delivered to the plenum 18 passes through the diffuser plate 22 and into the coating chamber 16 in an evenly distributed manner into contact with a powdered coating material 25. The gas entering the coating chamber 16 expands the volume occupied by the powdered material 25 resulting in a fluidized suspension of the particles comprising the material.

The particles of a powdered coating material will have varying diameters and may have particles ranging from 80 to 250 microns. The powder, however, may have particles outside of this range including particles that are less than 1 micron in diameter. The pores that perforate the diffuser plate 22, therefore, must be sufficiently fine such that a powdered material can be supported on the plate in a static condition without detrimentally affecting subsequent passage of a gas through the plate to fluidize the powdered material.

To coat an article, such as article 21, in the container 12, the article is heated to a temperature above the melting point for the powdered coating material 25. The article 21 is then inserted into the coating chamber 16 of container 12 through the open upper end 20 such that the article, or that portion desired to be coated, is immersed within the volume occupied by the fluidized coating material 25. To ensure that the insertion temperature of the article is above the coating material melting temperature, the heating device should be located sufficiently close to the container 12 to limit excessive cooling during the transfer of the article from the heating device to the coating chamber 16.

Figure 3:
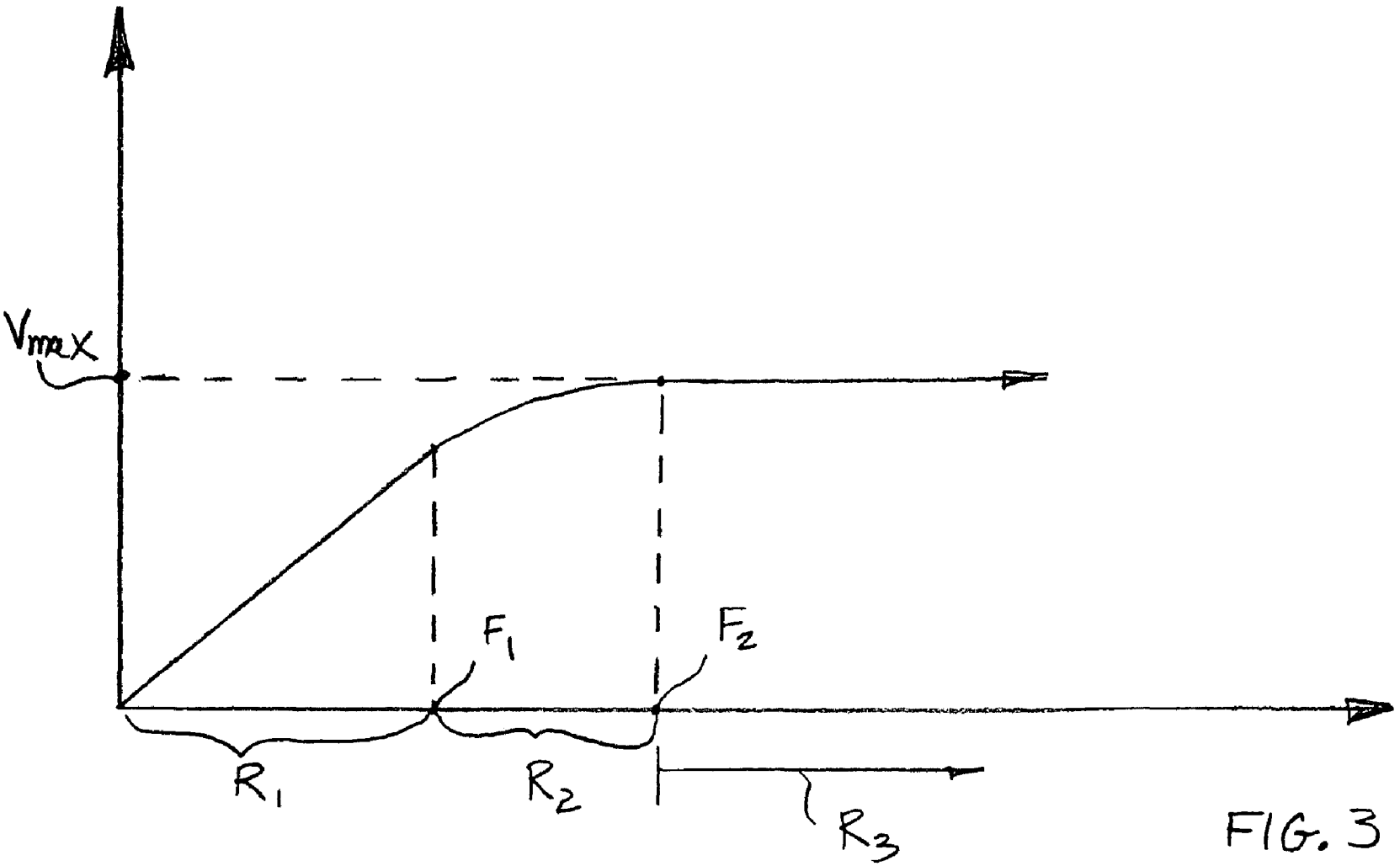
FIG. 3 is a graphical illustration of the relationship between fluidizing gas flow rate and resulting expanded volume for a suspended powder.

Entry of a fluidizing gas into the chamber 16 from the plenum 18 suspends the powdered material 25 in a fluidized condition that expands the powdered material from a volume occupied by the powder when supported on the diffuser plate 22 in a static condition. This fluidized volume for the powder 25 can be varied to a certain extent by varying the flow of gas delivered into the plenum 18. Referring to FIG. 3, the relationship between the flow rate of the fluidizing gas and the resulting fluidized volume for a powdered material, such as coating material 25, is illustrated graphically. Within a range of gas flow rate identified as $R_1$, the fluidized volume will vary substantially linearly with respect to change in the gas flow rate. This is true up to a certain gas flow rate, shown as $F_1$. Within a second range of gas flow rates above $F_1$, identified as $R_2$, the fluidized volume will vary non-linearly with respect to changes in the gas flow rate. There is, however, a maximum volume, identified as $V_{max}$, to which the powdered material 25 can be expanded by the fluidizing gas. The gas flow associated with Vmax is identified as $F_2$. For gas flow rates in a range above $F_2$, identified as $R_3$, the fluidized volume will remain substantially equal to $V_{max}$. In region $R_3$, the gas that is delivered to the plenum 18 beyond that associated with Vmax, functions to mix the particles of the powdered material 25. In this region, increased flow rates will generally provide for more vigorous mixing of the particles of the powdered coating material.

The gas supply system 24 of the present invention utilizes the above-described relationship between gas flow rate and expanded volume to limit coating problems associated with prior art powder fluidizing devices. The gas supply system 24 includes a primary fluidizing portion 26, which preferably supplies gas to the plenum 18 in a substantially continuous manner to provide for suspension of the coating material 25 in an expanded fluidized volume. The gas supply system 24 also includes a controllable pulsing portion 28, which delivers a gas to the plenum 18 to supplement the gas that is delivered by the primary fluidizing portion 26.

Preferably, the primary fluidizing portion 26 delivers gas to the plenum 18 at a rate that is within region R1 or R2. In this manner, gas from pulsing portion 28 supplementing the gas from primary portion 28 will result in an increase in the fluidized volume. As described below in greater detail, such variation in the fluidized volume results in movement of the upper surface of the fluidized bed. Such movement of the fluidized bed limits coating problems caused by a lack of dipping motion (i.e., a relative motion between the article being coated and the particles of the coating powder in the chamber 16). Preferably, the pulsing portion 28 will also be capable of delivering gas at a rate that results in a combined gas flow for the gas supply system 24 that is within region R3 to promote mixing of the fluidized powder. Such mixing limits coating problems associated with prior art powder fluidizing devices caused by a temperature gradient in the fluidized bed.

Referring again to FIG. 2, the gas supply system 24 is shown in greater detail. The fluidizing and pulsing portions 26, 28 are respectively connected to the plenum 18 of container 12 by piping 30, 32, or other suitable conduit, for delivery of a gas to the plenum 18. It is not required, however, that the fluidizing and pulsing gas supply portions 26, 28 be separately connected to the plenum 18. It is conceivable, for example, that separate conduits conveying gas from the separate sources could be merged into a single line for combined introduction into the plenum 18 via a single inlet.

Most preferably, the gas that is delivered to plenum 18 by gas supply system 24 is air. The fluidizing portion 26 of supply system 24 includes a blower 34 for delivery of high volume, low pressure, air to the plenum 18. The blower 34 will preferably run in a substantially continuous manner during operation of the gas supply system 24 to provide the primary source of air for suspending the particles of material 25 within the coating chamber 16 of the container 12. Preferably, the primary fluidizing portion 26 includes a gate valve 35 connected to piping 30 downstream of blower 34. The gate valve 35 provides for variable control over the quantity of air that is delivered to the plenum 18 by the primary fluidizing portion 26.

The air delivered by the pulsing portion 28 is preferably supplied by a source 36 of compressed air. Most preferably, the source 36 supplies compressed air at a pressure of approximately 80 to 90 pounds per square inch (psi). A pressure regulator 38 is connected to piping 32 between the compressed air source 36 and the plenum 18. The regulator 38 provides for variable control of the compressed air pressure within an output operating range for the regulator, between zero and ninety psi, for example. Preferably, the pulsing portion 28 includes a needle valve 39 connected to piping 32 downstream from the pressure regulator 38. The needle valve 39 provides for variable control over the quantity of air that is delivered to the plenum 18 by the pulsing portion 28 during an air pulse. The gas supply system 24 also includes a check valve 40 connected to piping 30 between the container 12 and the blower 34. The check valve 40 prevents air flowing in an upstream direction from reaching the blower 34 when the compressed air is delivered to the plenum 18 by the pulsing portion 28.

The pulsing portion 28 of gas supply system 24 further includes a solenoid valve 42 connected to the piping 32 downstream of the pressure regulator 38. The solenoid valve 42 has opened and closed conditions for alternately allowing and preventing delivery of compressed air to the plenum 18 of container 12.

The pulsing portion 28 of gas supply system 24 further includes a timer 44 connected to the solenoid valve 42 to control the actuation of the solenoid valve 42 between its opened and closed conditions. The timer 44 provides for metered actuation of the solenoid valve 42 resulting in delivery of discrete pulses of compressed air to the plenum 18. Preferably, the timer 44 is capable of varying the length of time that the solenoid will be opened during each cycle (i.e., the pulse duration) and separately varying the length of time that the solenoid valve 42 is closed (i.e., the duration between the pulses). The timer 44 shown in FIG. 2 includes first and second control knobs 46, 48 for respective adjustment of the length of time that the solenoid valve is opened and closed each cycle within a range, such as 0 to 10 seconds, for example. Separate control in this manner provides for variation of the pulse duration, by adjusting the first control knob 46, and variation in the pulse frequency, by adjusting the second control knob 48.

The construction of gas supply system 24 provides for first and second modes of operation respectively intended for use during coating of an article and when mixing of a fluidized coating material is desired. As described above, the primary fluidizing portion 26 preferably delivers a flow of air that is within range R1 or R2 to provide for variation in the fluidized volume by the pulsing portion 28. In the first mode of operation, the timer 44 is set to provide a duty cycle for the solenoid valve 42 that results in the delivery of relatively short duration pulses to the plenum 18. Most preferably, the duty cycle also results in delivery of the relatively short duration pulses at a frequency that is sufficient to limit the amount of time that the fluidized volume "dwells" at either the volume associated with the gas delivered by the primary portion 26 (i.e., in the absence of a pulse) or a relatively larger fluidized volume resulting from delivery of an air pulse by the pulsing portion 28. Limiting dwell time in this manner increases the amount of time that the fluidized volume will be varying within a given period of time, thereby promoting relative motion between the particles of the powdered material and an article being coated.

Figure 4:
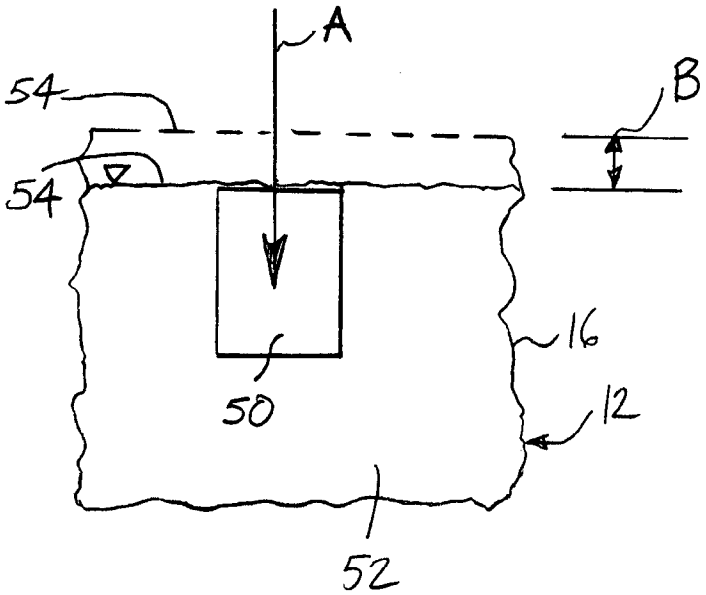
FIG. 4 is a schematic illustration showing the effect of operation of the gas supply system of FIGS. 1 and 2 in a first mode of operation.

Referring to FIG. 4, the effect of operation of the pulsing portion 28 of gas supply system 24 in the first mode on the fluidized material volume is shown schematically. An article 50 is shown immersed within a powdered coating material 52 in the coating chamber 16 of container 12. The arrow A is included to illustrate that the article 50 is moving in a downward direction relative to the container 12. It should be understood, however, that such relative movement does not necessarily require actual movement of the article 50. It is conceivable, for example, that a coating system could provide for insertion of the article 50 in the fluidized coating material 52 either by downward movement of the article in a dipping fashion or, alternatively, by upward movement of the container 12.

During the time that the article 50 is inserted into the fluidized material 52, the solenoid valve 42 of the pulsing gas supply portion 28 is cycled between its opened and closed conditions by the timer 44 in accordance with the first mode of operation in the manner described above. The change in the volume occupied by the fluidized material 52 results in a corresponding movement of the upper material surface 54, shown by arrow B in FIG. 4. The arrow B is shown as a double-headed arrow to indicate that the duty cycle set for solenoid valve 42 by timer 44 will likely result in multiple cycles in the movement of the upper surface 54 during the time that the article 50 is inserted in the fluidized material 52.

In a second mode of operation, the duty cycle for the solenoid valve 42 is modified to increase the length of time that the solenoid valve is opened during each cycle, thereby increasing the duration of the pulses. The pulse duration should be sufficiently long such that the fluidized volume will "dwell" at the relatively increased volume associated with the combined air flow delivered by the gas supply system 24 for more than a transitory period of time, preferably a significant period of time, during each pulse. In this mode of operation, promotion of particle agitation is desired rather than movement of the upper surface of the fluidized particles. The combined air flow delivered by the gas supply system 24 in the second mode of operation, therefore, will preferably be within region R3. As described above, the additional air beyond that associated with Vmax that is delivered by the gas supply system 24 will result in mixing of the fluidized powder. This mode of operation for the gas supply system 24 is intended for times when an article, such as article 50, is not being dipped into the fluidized material 52. The agitation of the particles of the powdered material 52 provided by the second mode for operation of the solenoid valve 42 tends to reduce any thermal gradient and promote homogeneity in particle distribution throughout the fluidized material, which might otherwise tend to become stratified based on particle size.

Figure 5:
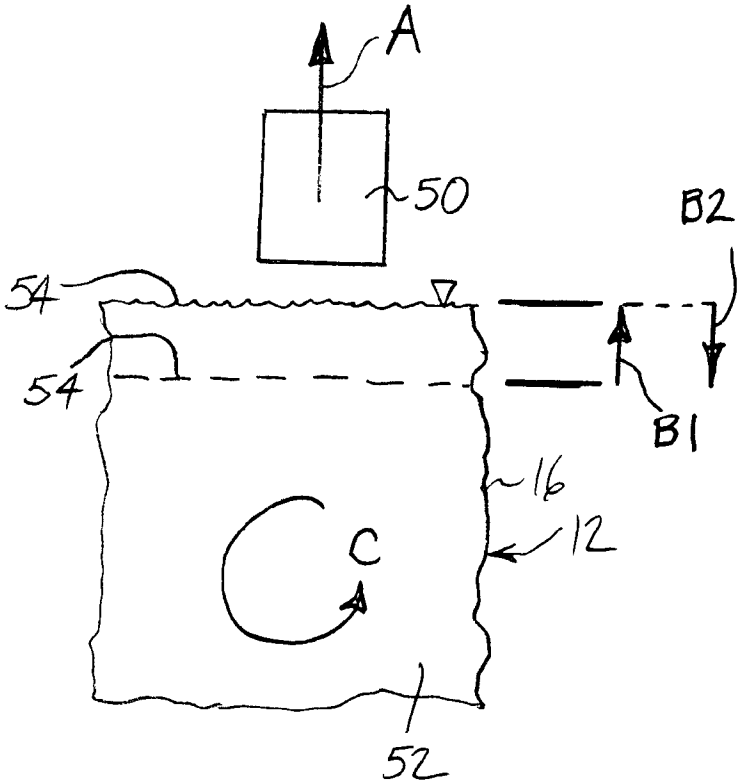
FIG. 5 is a schematic illustration showing the effect of operation of the gas supply system of FIGS. 1 and 2 in a second mode of operation.

Referring to FIG. 5, the effect that operation of the gas supply system 24 system in the second mode of operation has on the fluidized material 52 is shown. The article 50 is shown removed from the fluidized material 52 and moving in an upward direction relative to the container 12, as shown by arrow A. The movement of surface 54 during each air pulse is illustrated by separate arrows B1 and B2. Separate arrows connected by a dotted line are included to illustrate that the coating material will be maintained at the increased fluidized volume associated with the combined air flow for more than a transitory period of time during each pulse. Relatively long duration pulses providing a combined air flow in the R3 range results in desirable mixing of the particles as shown by arrow C.

Figure 7:
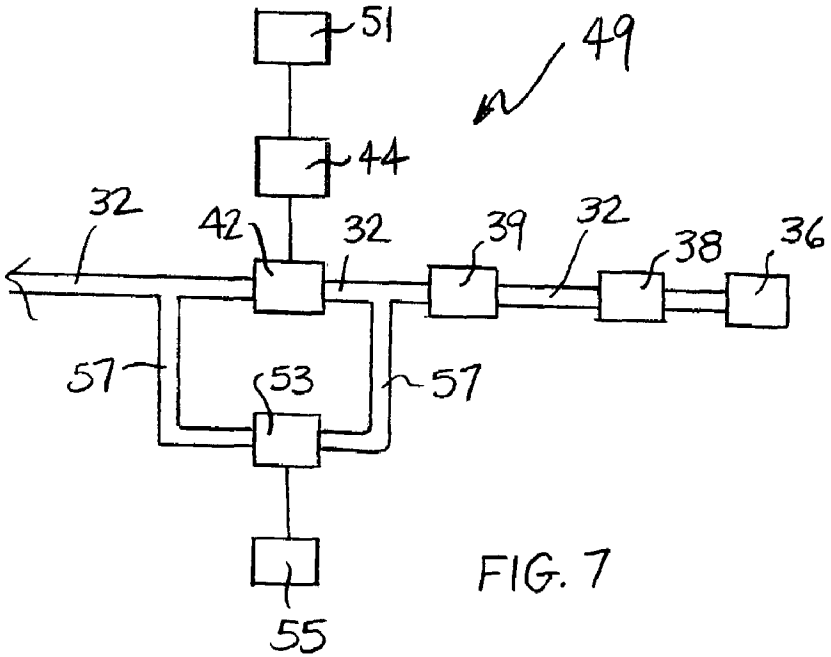
FIGS. 6 and 7 are schematic illustration of alternate pulsing portions for the gas supply system of the present invention incorporating a limit switch.
Figure 6:
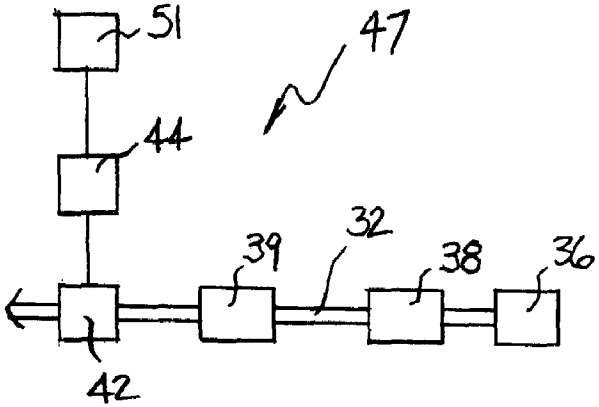

Referring to FIGS. 6 and 7, alternate pulsing gas supply portions 47, 49 of a gas supply system according to the present invention are respectively illustrated. The pulsing gas supplies 47, 49 are adapted for delivering cyclic pulses of gas to a plenum (not shown) of a powder-fluidizing apparatus, such as plenum 18 of FIGS. 1 and 2, for example. Each of the pulsing gas supplies 47, 49 includes a source 36 of compressed air and a pressure regulator 38 in a similar manner as pulsing portion 28 of gas supply system 24. Also similar to pulsing portion 28, each of the pulsing gas supplies 47, 49 includes a solenoid valve 42 and a timer 44 capable of directing cyclic pulses of gas to the plenum.

Each of the pulsing gas supplies 47, 49 includes at least one limit switch for enabling or disabling the actuation of a timer-controlled valve depending on a process parameter such as movement of the fluidized bed. Referring to FIG. 6, the pulsing gas supply 47 includes a limit switch 51 operably connected to the timer 44 to alternately enable or disable the timer 44 from actuating the solenoid valve 42. The timer 44, when enabled, is capable of controlling the solenoid valve 42 in the manner described for pulsing portion 28 to regulate the delivery of cyclic pulses of air.

Referring to FIG. 7, the pulsing gas supply 49 includes a limit switch 51 operably connected to the timer 44 for solenoid valve 42 in a similar manner as pulsing gas supply 47 of FIG. 6. Pulsing gas supply 49, however, also includes a second solenoid valve 53 and an associated timer 55. As shown, the second solenoid valve 53 is located on piping 57, which is connected at one end to piping 32 between the pressure regulator 38 and the first solenoid valve 42. Piping 57 is connected at its opposite end to piping 32 downstream of the first solenoid valve 42. The first and second solenoid valves 42, 53 are, therefore, separated from each other in a parallel fashion with respect to the gas from source 36.

Arranged in this way, solenoid valve 53 could be actuated by timer 55 to pulse in a relatively rapid manner associated with the above-described first mode of operation while the solenoid valve 42 is closed. As described previously, the first mode is intended for those times when an article is being coated to vary fluidized volume and simulate dipping motion. Timer 44 could be set to actuate solenoid valve 42 for delivery of relatively long pulses through valve 42 associated with the second mode of operation. As described previously, the second mode of operation is intended for those times when mixing of the powder is desired. It is not required that solenoid valve 53 be closed during a second mode operation. A continued actuation of solenoid valve 53 for rapid pulsing will not be detrimental to the mixing desired during the second mode of operation because solenoid valve 42 will be opened for relatively long duration pulses. Limit switch 51, however, is included to disable actuation of solenoid 42 during the first mode of operation. Actuation of the solenoid valve 42, and the associated mixing of the powder from a relatively long pulse, would detrimentally impact the first mode of operation in which variation in the powdered volume from rapid pulsing is the desired result.

Figure 8:
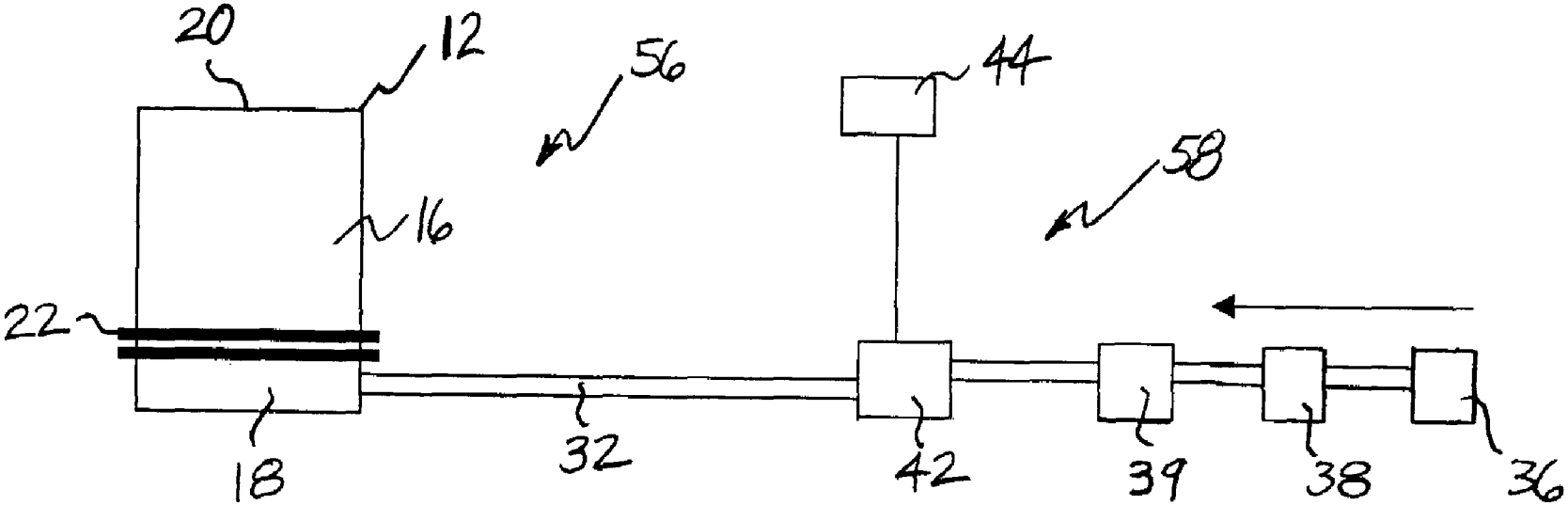
FIG. 8 is a schematic illustration of a powder-fluidizing apparatus according to the present invention including a gas supply system in which a controllable source of gas is the sole source of gas.

Referring to FIG. 8, there is shown a powder-fluidizing apparatus 56 according to the present invention including a gas supply system 58. The gas supply system 58 does not include a blower providing the primary source of air for fluidized suspension of a powdered material. Instead, a source 36 of compressed air, connected to the plenum 18 of container 12 through a solenoid valve 42 controlled by a timer 44, fluidizes the powdered material.

In gas supply system 58, the solenoid valve 42 must be opened for the powdered material to be fluidized. To provide for variation of the powder volume, and an associated movement in the upper surface, the solenoid valve is periodically turned off to cycle the powder volume between a fully-fluidized volume and a partially fluidized volume.

The movement of the powder surface in apparatus 56, therefore, results from a compression of the powder volume from the fluidized volume in contrast to apparatus 10 in which the supplemental compressed air, introduced in the form of air pulses, expands the fluidized volume. Compression of the powdered material from the fluidized volume, however, will need to be of limited amount to avoid detrimental effect on the ability to coat an article.

The gas supply system 49 shown in FIG. 7 was identified as a pulsing gas supply. It should be understood, however, that it not a requirement that the gas supply system 49 of FIG. 7 be used in combination with another source of air that provides the primary source of fluidizing air. The gas supply 49 could, alternatively, be used as the sole source of fluidizing air and still provide for a dual mode of operation in the following manner. Because source 36 is the sole source of air, the needle valve 39 would preferably be set for delivery of a quantity of air by the solenoid valve 42 that is in the $R_3$ range of FIG. 3 to facilitate mixing as described above. During a first mode of operation, solenoid valve 42 would be disabled by limit switch 51, to provide for variation in the powdered volume by actuation of the solenoid valve 53. When the gas supply shown in FIG. 7 is used as the sole source of air in this manner, the powdered volume will be compressed during the first mode of operation in a similar manner to that described above for sole source gas supply 58 of FIG. 8.

Figure 9:
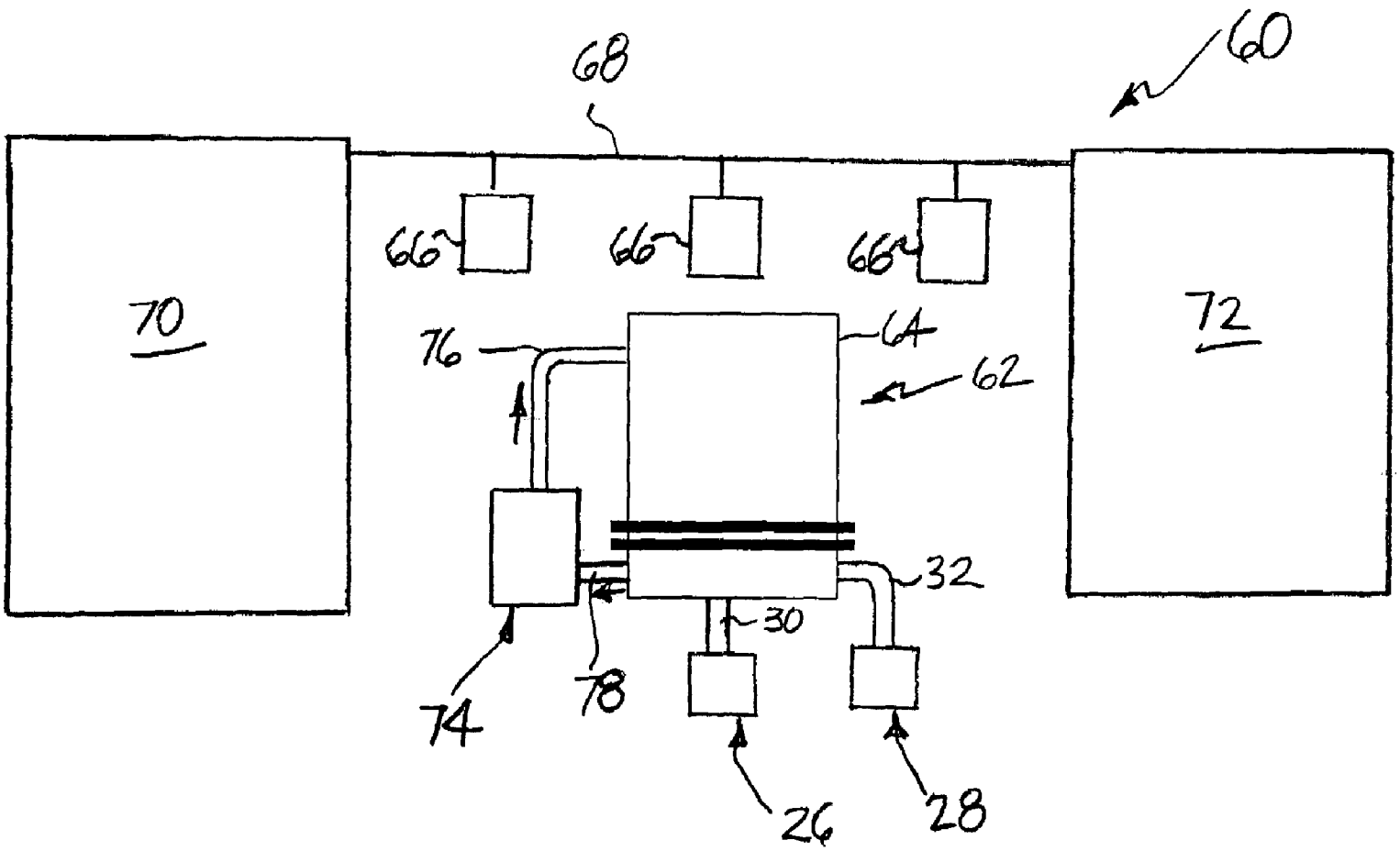
FIG. 9 is a schematic illustration of a continuous coating system incorporating the apparatus of FIGS. 1 and 2.

The present invention may be applied to a continuous coating system 60 as shown in FIG. 9. Articles 66 are transported in a continuous manner by a handling system 68 to a container 64 having a coating chamber 16 and plenum 18 separated by a diffuser plate 22. The handling system 68 provides for movement of the articles 66 and further provides for dipping of each article into the coating chamber 16 of container 64 for coating of the article by a fluidized material contained therein.

The continuous coating system 60 includes a preheat oven 70 upstream of the container 64 maintaining a temperature sufficient for heating the articles 66 to a temperature above the melting temperature of the coating material contained in the coating chamber 16. The continuous coating system 60 also includes a post fuse oven 72 located downstream from the container 64 for facilitating fusion curing of a coating applied to the article 66. The preheat oven 70 and the post heat oven 72 will need to be located sufficiently close to the container 64 to prevent excessive drop in the temperature of articles that would be detrimental to coating and curing. Heat will, therefore, be transferred to the container 64 via elevated air temperatures adjacent ovens 70, 72. To maintain powder temperature below its melting point, the container 64 is connected to a coolant system 74 including inlet and return lines 76, 78 for respectively delivering a liquid, such as water, to the container 64 and returning the liquid at an elevated temperature to remove heat.

In the harsh thermal environment of the continuous line, a temperature gradient may develop in the fluidized powder, notwithstanding the coolant system 60. Inclusion of a gas supply system 24 having a primary fluidizing portion 26 and a supplemental pulsing portion 28 allows for the dual mode of operation described above. The mixing provided by the second mode of operation limits the formation of a temperature gradient, thereby providing for increased efficiency of the coolant system 74. Such increase in the efficiency of the coolant system 74 allows for an increase in the temperature of the fluidizing air being directed into the plenum 18, which otherwise may have needed to be cooler to provide for additional cooling of the fluidized material.

The present invention is not limited to coating of articles by any particular coating materials. Representative materials, however, that could be used to coat articles using any of the apparatuses 10, 56, 62 include polyvinyl chloride (PVC), polyethylene (PE), polypropylene (PP), polyamides (PA), (e.g., nylons), polyvinyldene fluoride (PVDF), polysulfones, polyaryletheretherketone (PEEK), functionalized polyolefin alloys (FPAs), epoxy, polyester, epoxy/polyester hybrids, acrylic and urethane. This list of materials is not exhaustive and the present invention could be used with other coating materials.

As discussed above, the powders will include particles of varying diameters and may include particles having diameters ranging from sub-micron to approximately 250 microns. It is conceivable that the powdered material could include particles outside of this range. The percentage of particles outside of the above range, however, may be limited by the size of the perforating pores provided in the diffuser plate on the one hand and the capability of the gas supply system 24, 58 to suspend larger particles as part of a fluidized volume of material.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. An apparatus for coating an article by immersion of the article in a fluidized powder, the apparatus comprising:

a container defining an interior and a plate separating the interior into a coating chamber and a plenum, the plate perforated by a plurality of pores to provide for passage of a gas from the plenum to the coating chamber; and a gas supply system connected to the plenum of the container for delivery of a gas to the plenum;

the gas supply system comprising two separate supply portions:

a) a primary fluidizing portion capable of delivering a gas to the plenum in a quantity sufficient to suspend a powdered material in the coating chamber in a fluidized volume; and b) a controllable pulsating portion capable of providing cyclical pulses of gas, comprising a valve capable of being actuated between opened and closed conditions for respectively enabling and disabling delivery of a controllable supply of gas to the plenum so as to effect a corresponding cyclical variation in the fluidized powder volume, said valve being connected to a controller capable of effecting said actuation between opened and closed conditions in an automatically self-cycling manner to provide the cyclical pulses.

2. The apparatus according to claim 1, wherein the gas provided by the controllable supply portion is compressed air.

3. The apparatus according to claim 2, wherein the valve is a solenoid valve and wherein the control system comprises a timer for variably controlling the duration of the cyclical pulses of compressed air.

4. The apparatus according to claim 3, wherein the gas supply system further includes a blower connected to the plenum, either directly or via a same inlet as used by the controllable supply portion, for providing a primary supply of air that is supplemented by the controllable supply portion, the blower capable of substantially continuous delivery of air to the plenum in a quantity sufficient to suspend the powdered material in the coating chamber in a fluidized volume.

5. The apparatus according to claim 4, wherein the gas supply system further includes a check valve between the blower and the plenum to prevent passage therebetween of compressed air from the controllable gas supply.

6. The apparatus according to claim 2, wherein the gas supply system includes a pressure regulator for controlling the pressure of the compressed air delivered to the plenum.

7. The apparatus according to claim 1 wherein the controller for controlling the valve of the gas supply system comprises a limit switch operably connected to the control system for alternately enabling and disabling the control system from controlling the valve.

8. An apparatus for coating an article by immersion of the article in a powdered material suspended in a fluidized condition, the apparatus comprising:

a container defining an interior and including a divider extending across the interior to separate the interior into an upper coating chamber and a lower plenum, the divider perforated by a plurality of pores for passage of a gas from the plenum to the coating chamber; and a gas supply system including first and second portions, the first portion connected to the plenum and capable of a substantially continuous delivery of a gas in a sufficient quantity for suspension of a powdered material in the coating chamber in a fluidized volume, the second portion of the gas supply system connected to the plenum, either directly or via a same inlet as used by the first portion, for providing a controllable supply of gas supplementing the fluidizing gas delivered by the first portion, wherein said second portion is a controllable pulsating portion capable of providing cyclical pulses of gas, comprising a valve capable of being actuated between opened and closed conditions for respectively enabling and disabling delivery of the controllable supply of gas to the plenum so as to effect a corresponding cyclical variation in the fluidized powder volume, said valve being connected to a controller capable of effecting said actuation between opened and closed conditions in an automatically self-cycling manner to provide the cyclical pulses.

9. The apparatus according to claim 8, wherein the gas delivered by the second portion of the gas supply system is compressed air.

10. The apparatus according to claim 9, wherein the second portion of the gas supply system includes a control system for controlling the valve to deliver cyclical pulses of the compressed air to the plenum.

11. The apparatus according to claim 9, wherein the second portion of the gas supply system further includes a pressure regulator for variably controlling the pressure of the compressed air.

12. The apparatus according to claim 10, wherein the valve is a solenoid valve.

13. The apparatus according to claim 12, wherein control system includes a timer operably connected to the solenoid valve, the timer controlling the actuation of the solenoid valve to provide variable control of the duration of the pulses of compressed air.

14. The apparatus according to claim 13, wherein the timer is capable of variably controlling both the duration and the frequency of the compressed air pulses.

15. The apparatus according to claim 12, wherein the second portion of the gas supply system includes a limit switch operably connected to the solenoid valve for controlling the actuation of the solenoid valve.

16. The apparatus according to claim 13, wherein the second portion of the gas supply system includes a limit switch operably connected to the timer for alternately enabling and disabling the timer from controlling the solenoid valve, the second portion of the gas supply system further including, in parallel with the solenoid valve, a second solenoid valve and a second timer operably connected to the second solenoid valve for controlling the actuation of the second solenoid valve.

17. The apparatus according to claim 8, wherein the first portion of the gas supply system includes a blower.

18. The apparatus according to claim 17, wherein the gas supply system further includes a check valve between the container and the blower to prevent passage therebetween of compressed air from the second portion.

19. The apparatus according to claim 1, wherein the gas supply system is capable of delivering the gas to the plenum in a quantity sufficient to suspend a powdered material in the coating chamber in a fluidized volume.

20. The apparatus according to claim 1, wherein each of the cyclical pulses is no more than 10 seconds in length.

21. The apparatus according to claim 20, wherein a time between each of the cyclical pulses is no more than 10 seconds in length.

* * * * *